US006043472A

United States Patent [19]

Brückner et al.

[11] Patent Number: 6,043,472

[45] Date of Patent: Mar. 28, 2000

[54] ASSEMBLY OF TAPPING DEVICE AND INDUCTOR THEREFOR

[75] Inventors: Raimund Brückner, Neidernhausen; Daniel Grimm, Bad Schwalbach, both of Germany; Steve Lee, Cardross, United Kingdom

[73] Assignee: Didier-Werke AG, Wiesbaden, Germany

[21] Appl. No.: 09/065,490

[22] Filed: Apr. 24, 1998

Related U.S. Application Data

[62] Division of application No. 08/704,240, Aug. 28, 1996.

[51] Int. Cl.[7] ..... H05B 6/42

[52] U.S. Cl. ..... 219/677; 219/632; 336/60; 373/158

[58] Field of Search ..... 219/677, 632; 336/60, 62, 55, 57; 164/513; 75/10.14, 10.16; 373/158

[56] References Cited

U.S. PATENT DOCUMENTS 5,367,532 11/1994 Boen et al. ..... 373/156

FOREIGN PATENT DOCUMENTS

| | | |
|---|---|---|
| 531352 | 7/1931 | Germany . |
| 1011541 | 7/1957 | Germany . |
| 1200481 | 9/1965 | Germany . |
| 2279543 | 1/1995 | United Kingdom . |

*Primary Examiner*—Philip H. Leung
*Attorney, Agent, or Firm*—Weneroth, Lind & Ponack, L.L.P.

[57] ABSTRACT

In a method of operating an inductor of a tapping device of a melt vessel, the inductor couples inductively during a working phase with an electrically conductive shaped component and is cooled by means of a fluid. The inductor is electrically decoupled and cooled by means of a fluid in another working phase.

14 Claims, 2 Drawing Sheets

ASSEMBLY OF TAPPING DEVICE AND INDUCTOR THEREFOR

This is a Divisional Application of Ser. No. 08/704,240, filed Aug. 28, 1996.

BACKGROUND OF THE INVENTION

The invention relates to a method of operating an inductor and to an assembly including an inductor for carrying out such method.

In the prior art, an inductor is water cooled during operation. For this purpose, an induction coil has a hollow cross-section which defines a cooling passage (see EP 0 291 289 B1, EP 0 339 837 B1). Such water cooling serves to protect the inductor against overheating. Water cooling has, however, the disadvantage that any leaks result in potentially harmful and in any event undesired steam generation on discharge into a melt.

DE 41 36 066 A1 discloses a discharge device for a metallurgical vessel and a method of opening and closing a discharge or outlet sleeve. An inductor is to be moved relative to the discharge sleeve into different displacement positions in order to influence thermal conduction between the inductor and the discharge sleeve. In a first displacement position, a gap between the inductor and the discharge sleeve constitutes heat insulation and the electrically switched on, cooled inductor inductively melts a metal plug in the discharge sleeve. In the second displacement position, there is a thermally conductive connection between the inductor and the discharge sleeve. The inductor through which cooling medium flows is electrically switched off. The cooling down of the discharge sleeve which thus occurs permits the metal melt to freeze in the discharge sleeve. In order to be able to operate the inductor in both these working phases (displacement positions) it must be mechanically moved. This requires an appropriate actuation and control device.

An inductor at an outlet element of a melt vessel is described in German Patent Application P 44 28 297 and is installed directly in the base of a melt vessel or in an apertured brick in the base of the melt vessel. This inductor cannot be operated in a manner corresponding to DE 41 36 066 A1 because it cannot be moved with respect to the discharge sleeve.

SUMMARY OF THE INVENTION

It is the object of the invention to provide an assembly including an inductor and a variable operating method for such inductor.

The above object is solved in accordance with the invention by the provision of a method wherein an inductor is inductively coupled to an electrically conductive component during a first working phase while cooling the inductor by a fluid. In another working phase, the inductive coupling is reduced while cooling the inductor to a different extent than during the first working phase. The inductor in accordance with the present invention is in the form of an electrically conductive induction coil having therethrough at least one cooling passage. At least one supply line is connected to the passage for the supply thereto of the cooling fluid, and at least one discharge line is connected to the passage for the discharge therefrom of the cooling fluid.

The operating method of the invention has the advantage that it may be adapted in various ways to particular operational conditions. The assembly includes a tapping device, such as a free running nozzle, a passage, a stopper valve, a sliding gate valve and a tube valve or a transport trough and/or a vessel, and the inductor can be used for heating or cooling molten material, e.g. molten metal, in such tapping device by appropriate matching of the heating capacity and the cooling capacity. It can also be used for melting or solidifying metals or non-metals, particularly non-metallic slags and/or glasses. It can also be used for heating components, containers or transport elements which come into contact with melts. It is also advantageous that the inductor need not be moved during the working phases. It can therefore be installed in the tapping device or rigidly connected thereto.

Different fluids can be used in the working phases in the described method, such as liquid gas, dry ice, water or gas, particularly compressed air. Water preferably is not used. The use of liquid gas or dry ice as the cooling medium in the working phase in which a high cooling capacity is desired is not favorable because it can result in the dangerous generation of steam or explosive gases in contact with a melt in the event of discharge and a possible leak into the liquid gas or dry ice line. In the other working phase, in which a smaller cooling capacity is sufficient, compressed air can be used as the cooling medium. The use of compressed air is favorable because it is simple to use and inexpensive and also does not lead to the problems connected with water cooling.

In an exemplary method of operation, the melt is heated up by the inductor in a first working phase in at least one tapping device of a melt vessel. The inductor can inductively couple with the tapping device or, in conjunction with an electrically non-conductive shaped component, directly with the electrically conductive melt. The first working phase thus serves to heat the melt or the tapping device. A melt plug solidified in the tapping device optionally also can be melted. The inductor operates with a very high electrical power in the first working phase so that a molten edge zone is produced on the plug before the thermal expansion of the plug takes effect so that it splits the refractory material surrounding it. The liquid edge zone layer is squeezed out by the expansion of the plug which gradually occurs. Even at these high starting powers, a fluid, for instance liquid gas or dry ice and particularly compressed air, has proved to be an adequate cooling medium.

In another working phase in which the melt flows out freely with no or only slight subsequent heating, a smaller cooling capacity is sufficient with the electrical power reduced or switched off or the inductor electrically decoupled. Cooling is effected by means of the fluid, preferably compressed air. If a plurality of tapping devices are provided adjacent one another on the melt vessel and a reduced melt flow occurs at one or a number of the tapping devices as a result of a lower temperature, these tapping devices may be subsequently heated by an increased electrical power or a decrease in the cooling capacity so that the same melt flow occurs at all the tapping devices. Thermal radiation variations may thus be compensated for.

The melt can be cooled in a further working phase. The inductor is then electrically switched off. The cooling of the inductor is continued and is preferably effected with a high cooling capacity by water, liquid gas, dry ice or compressed air. This working phase serves, in particular, to freeze the melt in the tapping device in order deliberately to interrupt the flow of melt.

It is also possible by appropriate choice of the cooling capacity to freeze melt which penetrates into any cracks in the tapping device so that the cracks are closed. It is also possible to freeze a portion of the melt as a layer on the wall of the shaped component.

BRIEF DESCRIPTION OF THE DRAWINGS

Further advantageous embodiments of the invention will be apparent from the dependent claims and from the following description. In the drawings:

DETAILED DESCRIPTION OF THE INVENTION

Figure 1:
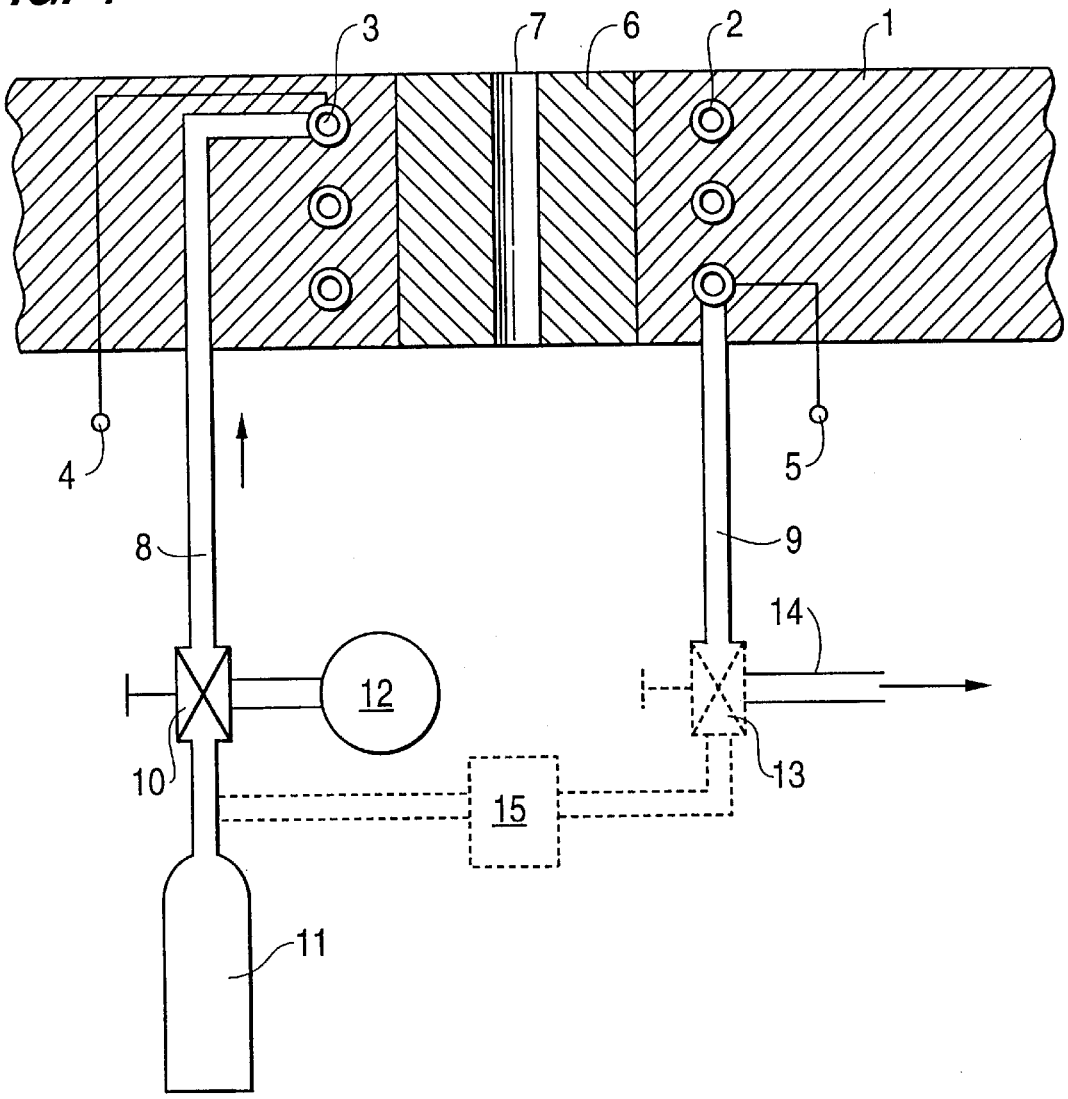
FIG. 1 is a schematic view of an apparatus for carrying out the method of the invention.

Installed in the base 1 of a melt vessel is an inductor 2 as shown in FIG. 1, including an electrically conductive induction coil with a hollow cross-section which defines a cooling passage 3 for a cooling fluid. The inductor 2 is connected to an electrical energy source by means of electrical connectors 4, 5. The inductor 2 includes a free running nozzle 6 of refractory ceramic material (molded member) inserted into the base 1 as a tapping device and defining a passage 7 for the discharge flow of melt.

Connected to the cooling passage 3 by a supply fluid connection on the one hand is an inlet conduit 8 and by a discharge fluid connection on the other hand an outlet conduit 9. The inlet conduit 8 is connected via a three-way valve 10 to a pressurized container 11 for liquid gas or a dry ice container and to a compressed air source 12. The dry ice also can be introduced into the inlet conduit in the form of rods or cartridges.

The mode of operation of the above described device is, for instance, as follows. If one assumes that the flow of melt has been interrupted by a melt plug deliberately frozen in the passage 7 and the flow of melt is to be started, then the inductor 2 is switched in a first working phase to a high electrical power and the three-way valve 10 is so positioned that liquid gas from the pressurized container 11 transforms into the gaseous state and flows through the cooling passage 3. The liquid gas can, for instance, be liquid nitrogen. Solidified $CO_2$ (dry ice) and particularly compressed air also are possible. The inductor 2, which heats up, is cooled by the liquid gas. Inductor 2 couples inductively either to the free running nozzle 6 or to a susceptor surrounding the free running nozzle which then melts the metal plug in the passage 7 by thermal conduction, or inductor 2 couples inductively directly with the melt or the metal plug so that the latter also melts.

The flow of melt is started by the melting of the metal plug. The electrical power of the inductor 2 now can be reduced or switched off because there is only a small subsequent heating requirement or none at all. Accordingly, the cooling capacity may also be reduced. This is effected by switching over the three-way valve 10 now at the latest to the compressed air source 12. In the ready phase the cooling is thus effected with air which maintains the consumption of liquid gas within limits.

If a plurality of free running nozzles with inductors are provided next to one another on the base 1, the inductors can be so controlled individually that the same amounts of melt flow out through the free running nozzles.

If cracks form, in operation, in the free running nozzle 6, such that the melt enters such cracks, the cooling can be so controlled that the melt which penetrates into the cracks freezes therein, but the main flow of the melt continues to pass through the passage 7.

If the flow of melt is to be interrupted, the inductor 2 is electrically switched off and the three-way valve 10 is switched over again to the pressurized container 11 or the throughput of compressed air is increased. The inductor 2 thereby is cooled with a high cooling capacity, whereby the free running nozzle 6 cools down accordingly as a result of thermal conduction and the melt in the passage 7 freezes into a plug which interrupts the flow of melt.

The cooling medium flows out of the outlet conduit 9 in the above described working phases. It can be released harmlessly directly into the environment. The liquid gas vaporizing in the inductor 2 or the warmed compressed air flows out in the working phases. If necessary, the liquid gas can also be conducted in a closed circuit. A device for this purpose is shown by dashed lines in FIG. 1. There is then a further three-way valve 13 provided on the outlet conduit 9 which leads on the one hand to a gas outlet 14 and on the other hand to a liquid gas reclaiming apparatus 15, for instance a compressor, which is connected to the three-way valve 10.

The described device is also usable with other tapping devices of a melt vessel and the inductor 2 is then installed not in the base 1 of a melt vessel but in a sliding gate valve apparatus or another component.

Figure 2:
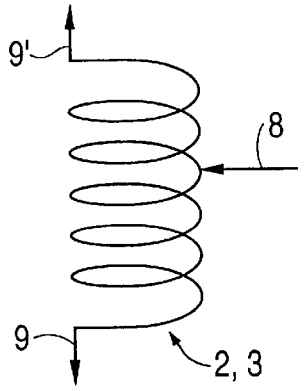
FIGS. 2–6 are schematic views showing different possibilities for supplying and discharging a cooling fluid in a helical inductor according to the invention.

In the embodiment of FIG. 2, outlet lines 9, 9 (cooling fluid drain lines) are connected by discharge fluid connection to both ends of the inductor 2. An inlet conduit 8 (cooling fluid supply line) is connected by a supply fluid connection to the cooling passage 3 of the inductor 2 in a region situated between the outlet conduits 9, 9'. The connection of the inlet line 8 is situated at a position on the inductor 2 which corresponds to the desired cooling conditions, for instance, it is situated in the middle of its length. The cooling medium entering through the inlet conduit 8 then flows on the one hand to the outlet conduit 9 and on the other hand to the outlet conduit 9'. The cooling action thus is improved.

The most strongly cooled point of the inductor 2 may be positioned in a desired region thereof.

Figure 3:
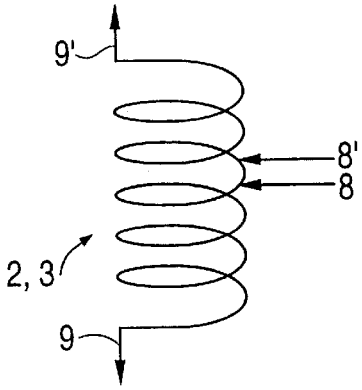

In the embodiment of FIG. 3, two inlet conduits 8, 8' are provided between the two outlet conduits 9, 9'. The cooling medium flow thereby may be reinforced and the cooling action thus improved.

Figure 4:
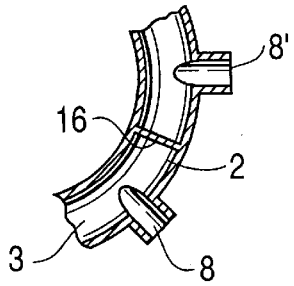

A partition wall 16 can be provided (see FIG. 4) in the cooling passage 3 of the inductor 2 between the inlet conduits 8, 8'. It is thus ensured that the cooling fluid flowing in through the inlet conduit 8 flows only to the outlet conduit 9 and the cooling fluid flowing in through the inlet conduit 8' flows only to the outlet conduit 9'. The inductor 2 may thus, depending on requirements, be cooled in its upper region with a different cooling fluid than in its lower region or may be differently cooled with a greater or lesser action in the two regions with the same cooling fluid.

Figure 5:
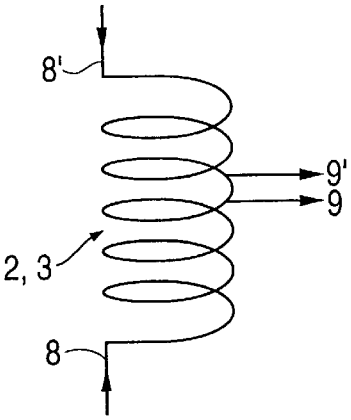

In the embodiment of FIG. 5, inlet conduits 8, 8' are arranged at opposite ends of the helical inductor 2. One or two outlet conduits 9, 9' are provided approximately in the middle of the inductor 2. The cooling action thereby also may be improved.

Figure 6:
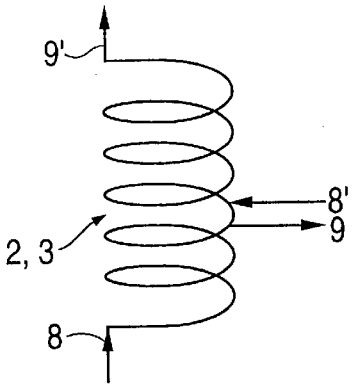

It is also possible to provide an inlet conduit 8 at one end of the inductor 2 and an outlet conduit 9' at the other end. There is then an outlet conduit 9 and an inlet conduit 8', separated by a partition wall 16, in the central region of the inductor 2. This is shown in FIG. 6. More than two inlet conduits and/or outlet conduits can also be provided in the inductor 2 in other embodiments of the invention.

Figure 7:
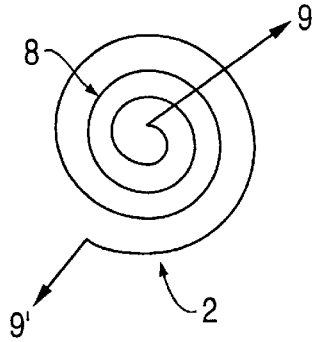
FIG. 7 is a schematic view of a spiral, plate-shaped inductor with a supply and discharge of cooling fluid.

FIG. 7 shows a spiral, plate-shaped inductor 2. A respective outlet conduit 9, 9' can be provided at each end in this case also, whereby the inlet conduit 8 is then connected to the inductor 2 between the outlet conduits 9, 9'. The alternatives described above also may be employed in the spiral inductor 2 of FIG. 7.

Figure 8:
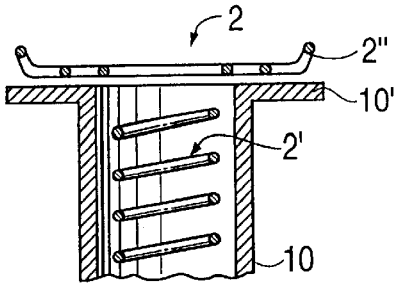
FIG. 8 is a partial sectional view of an inductor comprising a helical, twisted member and a spiral plate-shaped inductor member.

FIG. 8 shows an inductor which comprises the combination of a helical inductor portion 2' and a spiral inductor portion 2". This inductor is suitable, for a tapping device in the form of instance, for an immersion nozzle 10 constituting a refractory, ceramic molded component, whereby the coiled, helical inductor portion 2 is introduced into a cylindrical region of the immersion nozzle and the spiral, plate-shaped inductor portion 2" is associated with an upper broadened portion 10' of the immersion nozzle 10. The inductor portions 2, 2" can be switched electrically as a unit. Their cooling can be performed separately by appropriate inlet and outlet conduits, as described above regarding FIGS. 2 to 6.

Figure 9:
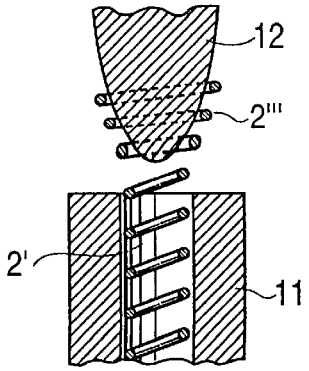
FIG. 9 is a partial sectional view of a modified embodiment of the inductor.

In the embodiment of FIG. 9, the coiled, helical cylindrical inductor portion 2' is connected or combined with a second helical inductor portion 2'". The second inductor portion 2'" broadens or widens conically, whereby the individual windings merge into one another at different or changing radii. The inductor portion 2' is used as an inner inductor for a melt nozzle 11 constituting a refractory, ceramic molded component. The inductor portion 2'" is used as an outer inductor for a stopper 12 which is associated with the melt nozzle 11 and is also a refractory, ceramic molded component. Nozzle 11 and stopper 12 form a tapping device for discharge of a melt. The inlet conduits and outlet conduits described above in connection with FIGS. 2 to 6 also can be employed in this embodiment.

We claim:

1. A cooled inductor to be connected to an electrical source and to thus be inductively coupled to an electrically conductive component, said inductor comprising:

an electrically conductive induction coil having therethrough at least one cooling passage, said coil having opposite ends;

each said at least one cooling passage having connected thereto at least one supply fluid connection for supply thereto of cooling fluid and at least one discharge fluid connection for the discharge therefrom of the cooling fluid; and said coil having at least three said fluid connections for supply and discharge of the cooling fluid to and from said at least one cooling passage, and including a first connection at a first said end, a second connection at a second said end, and a third connection at a middle portion of said coil located between said ends.

2. A cooled inductor as claimed in claim 1, comprising two supply fluid connections, one connected to each said end, and at least one discharge fluid connection connected to said middle portion of said coil.

3. A cooled inductor as claimed in claim 2, comprising two said discharge fluid connections connected to said middle portion.

4. A cooled inductor as claimed in claim 3, further comprising a partition wall at a position between said two discharge fluid connections and dividing said passage into two passages.

5. A cooled inductor as claimed in claim 1, comprising two discharge fluid connections, one connected to each said end, and at least one supply fluid connection connected to said middle portion of said coil.

6. A cooled inductor as claimed in claim 5, comprising two said supply fluid connections connected to said middle portion.

7. A cooled inductor as claimed in claim 6, further comprising a partition wall at a position between said two supply fluid connections and dividing said passage into two s passages.

8. A cooled inductor as claimed in claim 1, comprising a first supply fluid connection connected to said first end, a first discharge fluid connection connected to said second end, a second supply fluid connection connected to said middle portion of said coil, and a second discharge fluid connection connected to said middle portion.

9. A cooled inductor as claimed in claim 8, further comprising a partition wall at a position between said second supply fluid connection and said second discharge fluid connection and dividing said passage into first and second passages, with said first passage connecting said first supply fluid connection with said second discharge fluid connection, and with said second passage connecting said second supply fluid connection with said first discharge fluid connection.

10. A cooled inductor as claimed in claim 1, wherein said coil has a helical configuration.

11. A cooled inductor as claimed in claim 10, wherein at least a portion of said helical configuration is widened.

12. A cooled inductor as claimed in claim 1, wherein said coil has a spiral configuration.

13. A cooled inductor as claimed in claim 12, wherein said coil is flat.

14. A cooled inductor as claimed in claim 1, wherein said coil comprises plural separate coil portions.

* * * * *